United States Patent [19]

Hosek

[11] 4,292,022

[45] Sep. 29, 1981

[54] PRESSURIZED FLUIDIZED BED COMBUSTOR AND COAL GUN CONSTRUCTION THEREFOR

[75] Inventor: William S. Hosek, Mt. Tabor, N.J.

[73] Assignee: Curtiss Wright Corporation, N.J.

[21] Appl. No.: 62,745

[22] Filed: Aug. 1, 1979

[51] Int. Cl.[3] ..... F23D 19/00

[52] U.S. Cl. ..... 431/170; 110/245; 110/263; 432/58; 422/143; 34/57 A; 239/424; 239/600

[58] Field of Search ..... 431/7, 170, 187; 110/263, 243, 244, 245, 347; 122/4 D; 432/15, 58; 201/31; 422/139, 143, 145; 165/104 F; 239/600, 424; 34/57 A, 57 R; 423/DIG. 16

[56] References Cited

U.S. PATENT DOCUMENTS

| | | | |
|---|---|---|---|
| 2,628,965 | 2/1953 | Sullivan, Jr. | 165/104 F |
| 3,215,508 | 11/1965 | Piester | 34/57 A |
| 3,375,794 | 4/1968 | Albertson et al. | 110/245 |
| 3,443,761 | 5/1969 | De Groot | 239/600 |
| 3,861,862 | 1/1975 | Steever et al. | 34/57 A |
| 4,165,040 | 8/1979 | Beacham et al. | 432/15 |

FOREIGN PATENT DOCUMENTS

| | | | |
|---|---|---|---|
| 866481 | 4/1961 | United Kingdom | 165/104 F |

*Primary Examiner*—Samuel Scott

*Assistant Examiner*—Lee E. Barrett

*Attorney, Agent, or Firm*—McGlew and Tuttle

[57] ABSTRACT

A pressurized, fluidized bed combustor including a housing having a combustor chamber therein with a distributor plate closing the lower portion of the housing and arranged above a fluidizer windbox, which, in turn, is arranged above a heat exchanger inlet plenum which is mounted above a bottom of the combustor. A coal gun is provided for discharging coal into the fluidized bed, and it comprises an outer guide tube which extends from a spaced location above the distributor plate downwardly through the bottom of the combustor chamber and it includes a portion which extends exteriorly of the combustor chamber. This exterior portion carries a ball valve which has a passage therethrough which makes it possible to insert a coal supply pipe upwardly in the interior of the outer guide pipe and through the passage of the ball valve up to substantially the top of the outer pipe at a location above the distributor plate within the reaction bed. For withdrawing the coal supply pipe, it is possible to remove the pipe downwardly through the ball valve until the top end thereof is located directly below the ball valve but still within the outer diameter pipe and located within a stuffing box thereof. At such location, then the ball valve is closed and the ball supply pipe may be withdrawn all the way without reducing the pressure in the reactor.

8 Claims, 6 Drawing Figures

PRESSURIZED FLUIDIZED BED COMBUSTOR AND COAL GUN CONSTRUCTION THEREFOR

BACKGROUND OF THE INVENTION

Field of the Invention

This invention relates, in general, to fluidized bed combustors and, in particular, to a new and useful pressurized fluidized bed combustor and to a coal gun structure for use therewith which permits replacement of the coal gun without disturbing the pressurized combustion.

In the operation of a pressurized fluidized bed combustor, it is not unusual for one or more of the parts of the combustor to require service during operation so that these parts must be removed. In particular, it is desirable that the devices for directing coal into the pressurized bed be such that one or more of them can be placed out of operation and/or removed while still others continue to operate. With the known devices, a device for directing coal into the combustor could be removed only upon shut-down of the combustors, and this is both costly and time-consuming and, in addition, it may require operations for long periods of time with an inoperative coal gun until a convenient time could be selected for the replacement of the particular gun.

SUMMARY OF THE INVENTION

In accordance with the present invention, a coal gun for a fluidized bed combustor is provided which comprises an outer guide pipe which has a first end adapted to terminate in the fluidized bed of the combustor and an opposite bottom end which extends out of the combustor housing. A coal supply pipe is disposed within the outer guide pipe and it has a first end terminating substantially adjacent the first end of the outer pipe in the fluidized bed. The space between the two pipes is used for supplying air for cooling the coal supply pipe. A valve is located in the outer tube adjacent its second end, and it includes a setting in which a passage is aligned with the interior of the outer tube so that the coal supply pipe may be positioned within the outer tube and passed through the passage. The valve member may be oriented to close off the outer guide tube and this is done when the coal supply pipe is withdrawn outwardly from below to a location in which its first end extends exteriorly of the valve and is out of the valve passage. This withdrawal of the coal supply pipe is effected after a valve in the coal supply pipe is first shut off to discontinue the supply of the coal and when the first end of the coal supply pipe clears the valve in the outer guide tube, the valve of this outer guide tube may be closed to seal off the connection of the outer guide tube to the fluid bed of the combustor.

In the preferred construction, the outer guide tube is made up of a plurality of interconnected sections with at least one of them being mounted on a bellows-like structure to permit its movement to accommodate thermal changes. The lower end of the outer guide tube advantageously contains a ball valve with the passage for the inner coal supply pipe. Air is supplied to the space between the tubes from the exterior of the combustor and it exits from the outer guide pipe at a location directly below the termination of the inner coal supply pipe inside of the fluidized bed. The lower end of the outer guide pipe is provided with a packing below the ball valve and it includes a clamped structure permitting the release of the inner coal supply pipe. The packing serves to seal the interstices between the coal supply pipe and the outer guide tube or pipe. It also functions during the withdrawal of the coal supply pipe to maintain the interior of the fluidized bed combustor out of communication with the ambient air during the time the coal supply pipe is withdrawn to a location clear of the valve in the outer guide pipe and that valve is actuated to a position fully closing off the flow area of the outer guide pipe.

Accordingly, it is an object of the invention to provide a fluidized bed combustor and a coal gun therefor which includes a substantially vertical outer guide pipe having a top end adapted to terminate in a fluidized bed and an opposite bottom end which extends out of the combustor, a coal supply pipe being disposed within the outer guide pipe and having a top end extending substantially to the top of the outer guide pipe and an opposite bottom end extending out of the bottom of the combustor and where in the space between the two pipes defines an air flow space for cooling air, the outer guide pipe having a valve with a passage therein which is alignable with the interior of the outer guide pipe to permit the passage of the coal supply pipe through the passage of the valve which may be closed off when the coal supply pipe is removed downwardly, the coal supply pipe also having a portion extending exteriorly of the outer guide pipe which has a close-off valve for shutting off the coal supply.

A further object of the invention is to provide a fluidized bed combustor and/or a coal gun for the combustor which are sumple in design, rugged in construction and economical to manufacture.

For an understanding of the principles of the invention, reference is made to the following description of typical embodiments there of as illustrated in the accompanying drawings.

GENERAL DESCRIPTION OF THE PREFERRED EMBODIMENTS

Figure 1:
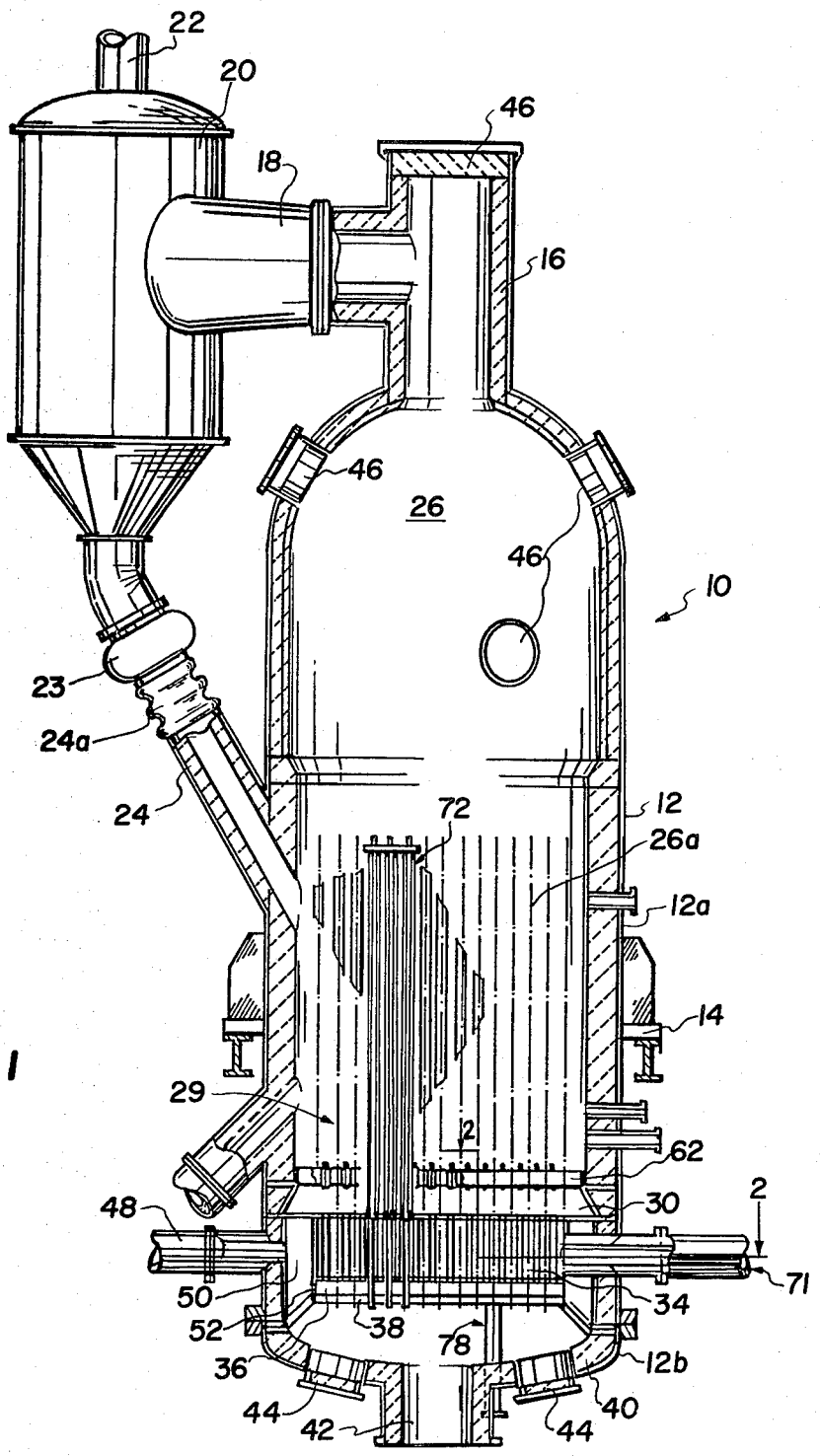
FIG. 1 is a partial vertical sectional view, partly in elevation, of a fluidized bed combustor constructed in accordance with the invention.
Figure 2:
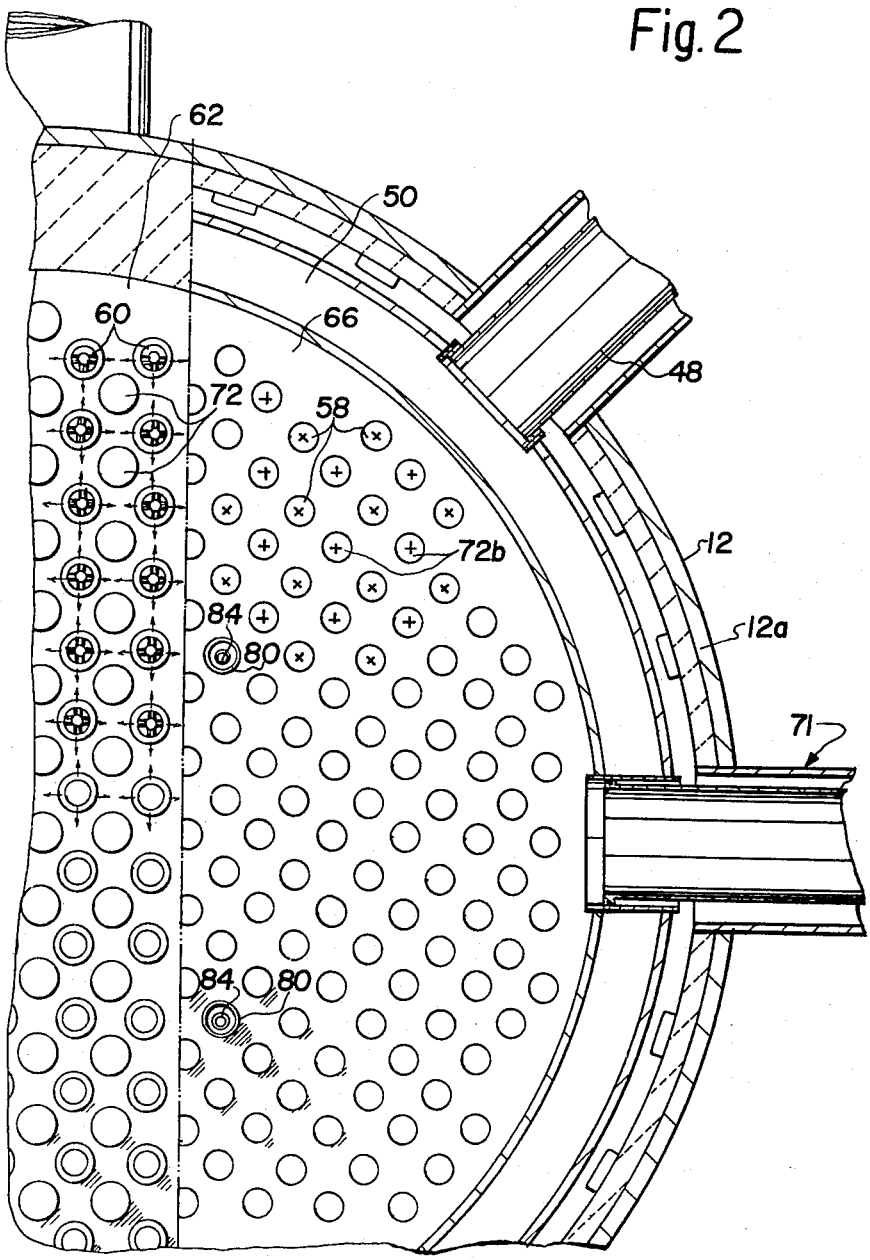
FIG. 2 is an enlarged partial sectional view taken along the line 2—2 of FIG. 1.

Referring to the drawings, in particular, the invention embodied therein in FIG. 1 comprises a pressurized fluidized bed combustor generally designated 10 including a housing 12 having an upper portion 12*a* and a lower portion 12*b* which are bolted together and supported on four supports 14. The top of the combustor housing 12 includes a flue offtake 16 which connects laterally into a flue gas connection 18 to a separator 20. The separator 20 permits escape of the cleaned gases through an exhaust 22 and the solid particles are returned through a trickle valve 23 and return line 24 (having an expandible bellows section 24*a*) to the combustor 10 at the location of a fluidized bed portion 26*a* of a chamber 26. The fluidized bed 26*a* is formed above a distributor plate 62 of an assembly 29 which also includes a windbox 30, a heat exchanger inlet plenum chamber 34, a lower fluidizing air supply section 36 and a bottom support wall 38 which is spaced upwardly from a bottom 40. The bottom 40 has a main discharge 42 and a plurality of access openings or manholes 44. The upper portion 12*a* of the housing 12 also includes access openings or manholes 46.

Figure 3:
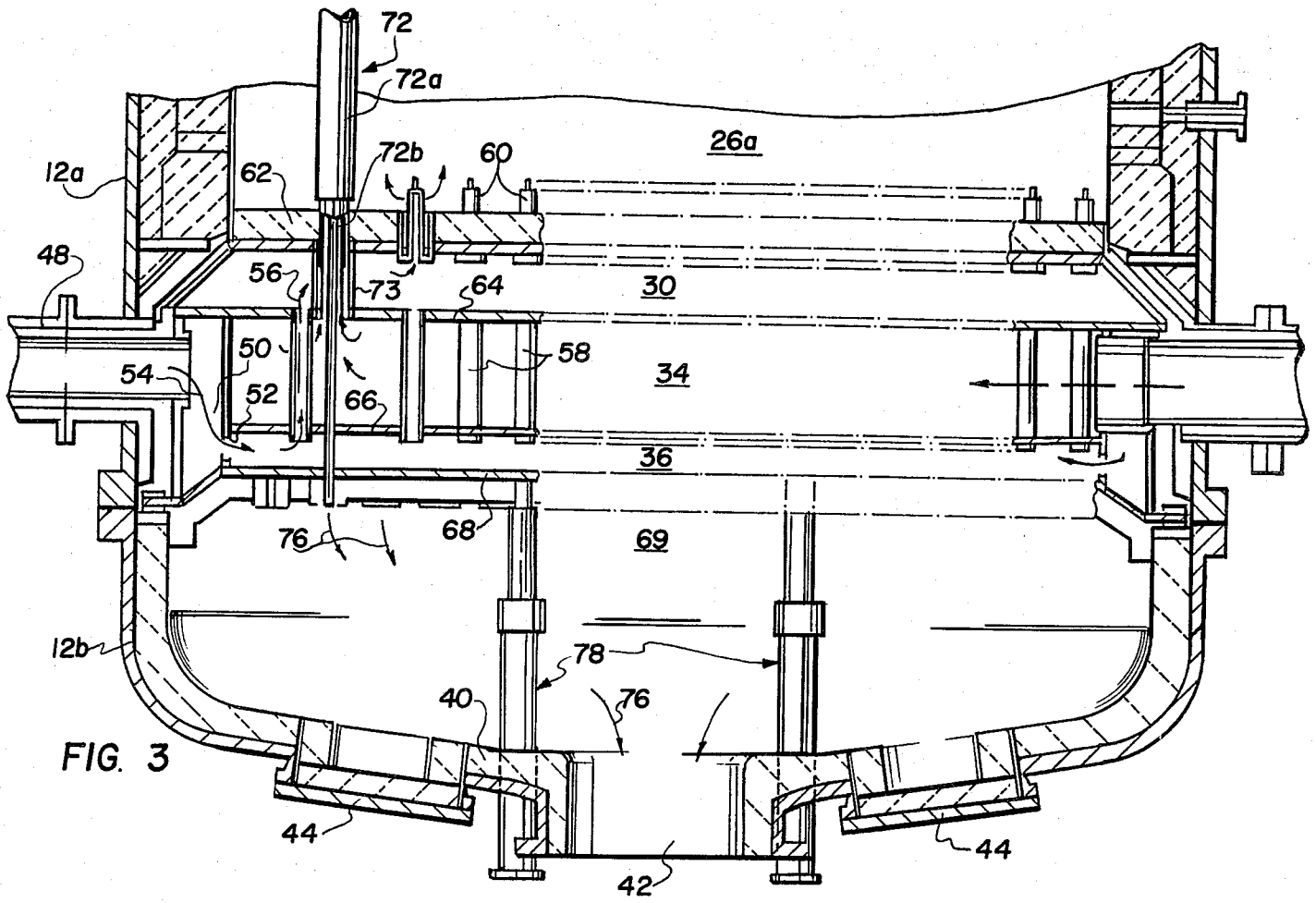
FIG. 3 is a view similar to FIG. 1, but on an enlarged scale, showing the lower portion of the combustor shown in FIG. 1.

Fluidizing air is supplied through a fluidizing air supply pipe 48 into an annular space 50 which surrounds the heat exchange inlet plenum 34 and the lower section 36. The fluidizing air flows into the lower section 36 through one or more inlets 52 which connect to the annular space 50 and air moves, as best seen by arrows 54 and 56 in FIG. 3, for passage upwardly through tubes 58 which extend through the heat exchange inlet plenum 34 for passage into the windbox 30 and for subsequent passage through tuyeres 60 which extend through a distributor plate 62 into the reaction bed area 26*a*. The windbox 30 includes a bottom wall 64 spaced downwardly from the distributor plate 62 and a wall 66 is spaced downwardly from the wall 64 to define the heat exchanger inlet plenum 34 therebetween. Lower section 36 is bounded by the wall 66 on its top and an assembly bottom wall 68 on its bottom. An assembly bottom wall 40 of the housing 12 is spaced below the lower section 36 and a heat exchanger fluid outlet chamber 69 is defined between the wall 68 and assembly bottom wall 40. A cooling fluid or a heat exchanger fluid is directed through one or more heat exchanger pipes, generally designated 72, which engage into the heat exchange inlet plenum 34, and this fluid moves in heat exchange with the fluidized bed 26*a*.

The fluid for use in the heat exchange with the fluidized bed 26*a* is passed between inner and outer pipes 72*b* and 72*a* of a heat exchanger pipe assembly 72 which extends upwardly in the fluidized bed area above the distributor plate 62 and which has its outer tube portion 72*a* seated in a tubular receiving socket 73 located between walls 62 and 64. A lower support arrangement (not shown in detail) for the inner tube 72*b* is provided at the location of the bottom wall 68 of the assembly. A fluid which passes through the heat exchanger inlet plenum 34 passes upwardly between the inner and outer pipes of the heat exchange pipe assembly 72 and flows upwardly in the space between the pipes and then returns downwardly in the inner pipe for discharge from the inner pipe 72*b* below the bottom wall 68 and into the heat exchanger outlet plenum 69. Air which is thus discharged passes in the direction of arrows 76 and is discharged through the lower discharge opening 42 of housing 12. Coal is directed by one or more coal guns 78 into the fluidized bed 26*a*.

Figure 4A:
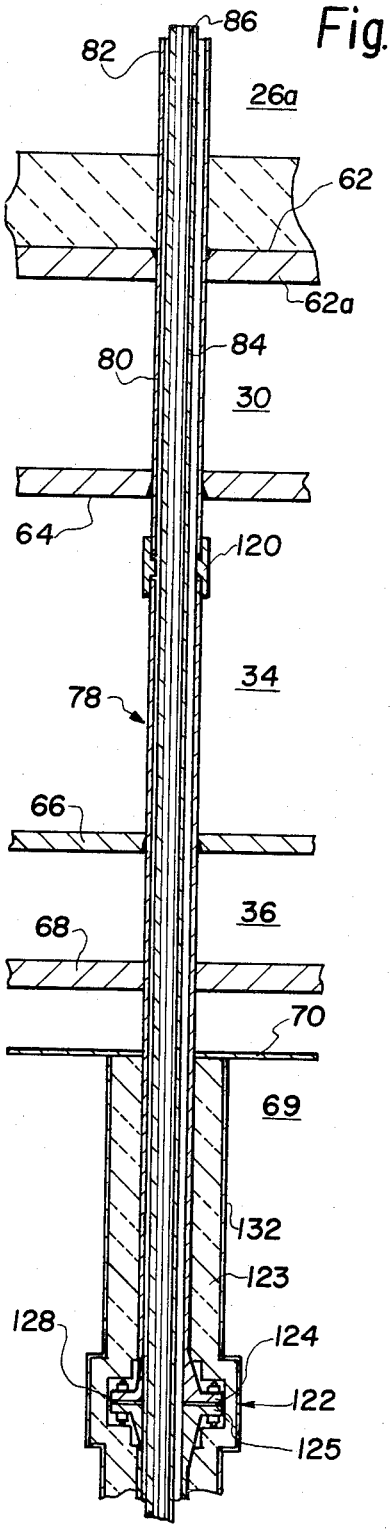
FIG. 4*a* is an enlarged sectional view of a top portion of a coal gun assembly for the combustor shown in FIG. 1.
Figure 4B:
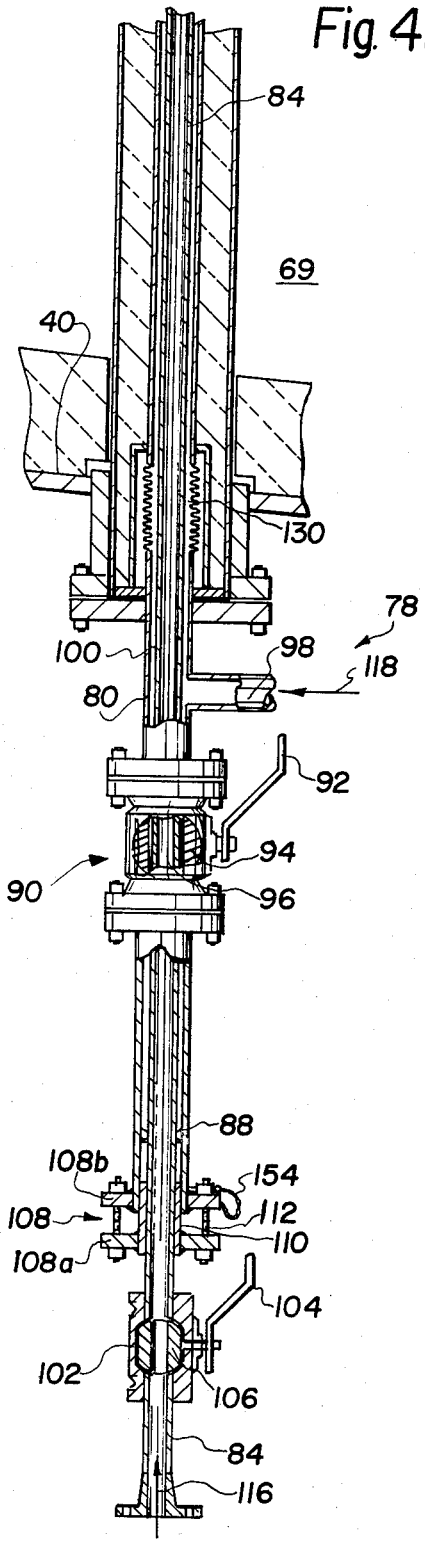
FIG. 4*b* is a view similar to FIG. 4*a* of the bottom portion of the coal gun assembly shown in FIG. 4*a;*

In accordance with the invention, a coal gun assembly, generally designated 78, as best shown in FIG. 4*a* and 4*b*, comprises a means for conveying coal vertically through pressurized fluid bed combustor housing walls, heat exchanger air outlet chamber 69 and through the lowest section 36, the heat exchanger inlet plenum 34 and the windbox 30 and through the distributor plate 62 to a top end at a spaced location thereabove in the fluidized bed 26*a*. In accordance with the invention, the coal gun 78 includes an outer tube portion or guide tube 80 adapted to be mounted substantially vertically having a top end 82 which terminates above the distributor plate 62. An inner tube, located within the outer guide tube 80 defines a coal gun supply pipe 84, and it has a top end 86 which is located slightly above the end 82 of the outer guide tube 80. The outer guide tube 80 has a lower end 88 which extends considerably below the bottom wall 40 of the housing 12. In this section, which extends below the bottom wall 40, there is provided a close-off valve in the form of a movable ball valve 90 having a handle control 92. The handle control 92 effects the shifting of a ball member 94 which has a passage 96 defined therein through which the inner tube 84 extends when the passage is aligned with the passage through the tube 80. When the lever 92 is shifted, the passage 96 may be oriented transverse to the passage of the tube to close off the tube 80 after the inner pipe 84 is withdrawn so that its top end 86 extends below the passage of the valve 90.

Air is advantageously directed through an inlet passage 98 located adjacent the valve 90 and it flows into a space 100 between the inner and outer pipes 80 and 84. The air circulated exits at the top 82 of the outer pipe 80 and it may be used to purge the space of ashes and other materials during operation when the gun is shut down and the gun supply tube 84 is withdrawn downwardly below the level of the valve 90. For such withdrawal, a close-off valve 102 is provided in a length of the inner tube 84 which extends below the outer tube lower end 88. The valve 102 comprises an actuating lever 104 which shifts a valve member 106 to close off the interior of the inner tube 84 and stop feeding of the coal before the tube 84 is withdrawn downwardly through the outer tube 80. The lower end 88 of the outer tube is provided with a clamping mechanism 108 which includes spaced plates 108*a* and 108*b* which are connected between a packing sleeve 110 and the lower end 88 of the outer pipe 80. The plates 108*b* and 108*a* are clamped together by clamping bolts 112 which may be tightened in order to tighten the sleeve 110 in the space between the outer pipe and the inner pipe 84. A packing material is advantageously disposed in the space between the outer tube 80 and the inner tube 84 which extends below the valve 90 to the end 88.

Figure 5:
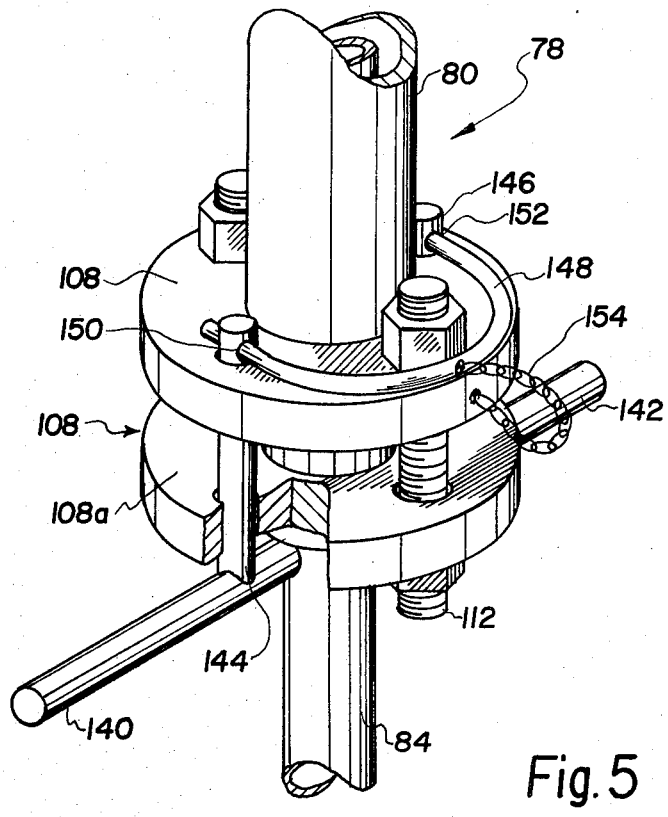
FIG. 5 is a partial perspective view showing the locking connection of the coal gun supply pipe to the outer guide tube.

To facilitate the insertion and removal of the coal gun supply tube 84, the tube is provided with handle elements or yoke members which extend radially outwardly from diametrically opposite sides of the coal gun supply pipe. Axially extending rods 144 and 146 are connected at their one ends to the handle elements 140 and 142 at a space location from the coal gun supply tubes 84 and they extend through openings of plates 108*a* and 108*b*. The locking pin or U-shaped securing member 148 has respective leg portions which extend through openings 150 and 152 of the rods 144 and 146 respectively. In the position indicated in FIG. 5, coal gun supply tube 84 cannot be withdrawn, but for withdrawal purposes the locking pin 148 is removed to permit the rods 144 and 142 to move downwardly through the plates 108*a* and 108*b*. For security purposes the locking pin 148 is held to the plate 108*b* by a chain 154.

The coal pellets are directed into the pipe 84 in the direction of arrow 116. Air, to cool the coal pipe 84, flows in through the air inlet 98 in the direction of the arrow 118 and, during operation, exits from the top of outer pipe 82 in the fluidized bed 26*a*. This same air may be used to scour the space between the coal feed pipe 84 and outer guide tube 80. The air may also be used to purge the whole outer pipe 80 when the coal feed pipe 84 is withdrawn and after the valve 90 is closed.

The outer pipe 80 is advantageously made of three separate sections or lengths which are interconnected, for example, by a threaded coupling 120. The upper pipe section is welded to the upper section of the windbox 30 at the location of the upper plate portion 62*a* of the distributor plate 62 and the lower plate portion 64. The center pipe section is screwed into the coupling 120 which is carried on the upper pipe section and it is welded to the lower section 36 or to plates 66 and 68 thereof. The lower pipe section, which is below the section which extends through the heat exchange inlet chamber 34 and the lower section 36, mates with the center section at a gasketed flange joint generally designated 122 which includes respective flanges 124 and 125, secured to a middle section and lower section, respectively, of the pipe 80 having a gasket 128 therebetween. The joint is covered by insulation 123 which also extends to a location at which the pipe section extends through a lower wall 40 of the vessel housing 12. At this latter location, the section is interrupted by a bellows connection 130 which provides means for compensating for thermo-and dimensional variations between the lower vessel and the heat exchanger distributor assembly which contains the windbox 30, the heat exchange inlet plenum 34 and the lower section 36. The insulation is enclosed and supported by a metal wall 132. The wall 132 is advantageously constructed in segments in order to facilitate the assembly and disassembly.

The inner coal supply pipe 84, of course, extends through all of the sections of the outer guide pipe 80. The lower portion of the outer guide tube 80 is in the form of a stuffing box where it extends below the ball valve 90. The arrangement shown in detail in FIG. 5 permits the coal supply pipe or coal gun pipe 84 to be withdrawn while the system is operating. This is accomplished first by closing the valve 102 to shut off the supply of coal and then by releasing the locking assembly and withdrawing the coal supply pipe 84 so that the top injector end 86 is brought down into the stuffing box area below the valve 90. It is at this location that the ball valve 90 may be closed so that the pressure is maintained within the combustor 26 and then the coal supply pipe 84 may be completely withdrawn. The packing material adjacent sleeve 110 (stuffing box area) functions before ball valve 90 is actuated to a closed position, to prevent leakage of the high temperature and pressure gases from the interior of combustor 26 after the inner coal supply pipe 84 is drawn past ball valve 90 and held in the stuffing box area and the time required to move ball valve 90 to a fully closed position. The coal supply pipe 84 is reinstalled by reversing this procedure.

The inventive construction provides a coal gun assembly which includes the outer guide tube 80 and the inner coal supply pipe of gun 84 which may be easily installed to the fluidized bed combustor housing 12. The outer tube 80 is more permanently positioned, but it, too, may be withdrawn with the associated assembly 29 of the windbox 30, the heat exchanger inlet plenum 34 and the lower section 36. The coal supply tube 84 may be installed at any time and rapidly by following the procedure outlined above. The construction is such that the coal gun assembly will operate and accommodate thermal variations which occur in the combustor between the vessel wall and the internal elements. Because the gun may be withdrawn during operation of the combustor, a great deal of time and cost is saved in the replacing of one or more guns. The construction in which the air is circulated between the outer guide tube 80 and the coal supply pipe 84 and shows that the coal will not be heated too early so as to cause combustion during its delivery. In addition, the air provides a means for purging the outer pipe sections, both prior to inserting the gun and after the gun is withdrawn.

While specific embodiments of the invention have been shown and described in detail to illustrate the application of the principles of the invention, it will be understood that the invention may be embodied otherwise without departing from such principles.

What is claimed is:

1. A fluidized bed combustor comprising a housing defining an interior chamber having a top portion for the discharge of combustion gases and having a bottom with an outlet for cooling fluid, a distributor plate extending across a lower portion of said chamber having a plurality of tuyeres for the discharge of fluidizing air therethrough, means defining a windbox below said plate communicating with said tuyeres, means defining a heat exchanger inlet plenum below said windbox having a plurality of tubes extending therethrough for the passage of air to said windbox, means defining a lower section below said heat exchanger inlet plenum with a connection to an air supply for supplying air through the tubes to said windbox, heat exchanger tube means adapted to extend above said distributor plate and being mounted in said windbox and said heat exchanger inlet plenum and said lower section and having a passage from said heat exchanger inlet plenum upwardly through said heat exchanger tubes above the distributor plate and then downwardly back to the distributor plate for discharge below said lower section to the outlet for the cooling fluid, means for circulating a cooling fluid into said heat exchanger inlet plenum around said tubes extending therethrough and into said heat exchanger tubes for flow upwardly therethrough and then downwardly for discharge after they are heated to outlet for the cooling fluid, means defining a fluidized bed area above the distributor plate in the vicinity of the upper portions of said heat exchanger tubes, and a coal supply gun including an outer guide pipe extending substantially vertically through the bottom of said housing through said lower section, said heat exchanger inlet plenum and said distributor plate terminating in said chamber above said distributor plate, said chamber having a space over said distributor plate defining a fluidized bed, a coal supply pipe disposed within said outer guide pipe and terminating in a top end extending substantially to the top of said outer guide pipe having an opposite coal supply pipe bottom end extending out of the bottom end of said outer guide pipe, means for directing air into the space between said coal supply pipe and said outer guide pipe for discharge in the fluidized bed, an outer guide pipe shut-off valve provided in said outer guide pipe at a location thereof which extends out of the combustor housing, said shut-off valve including a valve member therein which is movable to open and close the valve having a passage therethrough which aligns with the interior of said outer guide pipe when the valve is open and which extends transversely thereto when the valve is closed, said coal supply pipe extending through the passage of said movable valve member when the passage is aligned with the interior of said outer guide pipe, and a shut-off valve in said coal supply pipe in the position thereof extending out of said outer guide pipe and exteriorly of said housing chamber and being closeable to close off said coal supply pipe, said coal supply pipe being withdrawable from said outer guide pipe to a location below said outer guide pipe shut-off valve, said outer guide pipe shut-off valve being closeable to close off said outer guide pipe and permit further withdrawal of said coal supply pipe from the bottom of said combustor.

2. A fluidized bed combustor according to claim 1, wherein the portion of said outer guide pipe extending outwardly of said valve in said outer guide pipe defines a stuffing box surrounding said coal supply pipe, a sealing ring disposed around said coal supply pipe between said coal supply pipe and said outer guide pipe in said stuffing box located adjacent said valve in said outer guide pipe, packing extending exteriorly of said sealing ring between said coal supply pipe and said outer guide pipe, a clamp flange carried by said outer guide pipe adjacent said bottom end of said outer guide pipe, a sleeve member insertable into the space between said outer guide pipe and said coal supply pipe adjacent the bottom end of said outer guide pipe, and clamping bolt means defined between said sealing sleeve and said flange for tightening the packing in said stuffing box.

3. A fluidized bed combustor according to claim 1, including locking means for locking said coal supply pipe from withdrawal from said outer guide pipe.

4. A fluidized bed combustor according to claim 1, wherein said outer guide pipe includes a portion having an exterior wall with corrugations permitting thermal expansion and contraction.

5. A fluidized bed combustor according to claim 1, wherein said outer guide pipe is made up of a plurality of interconnected sections including a wall penetrating section adapted to penetrate a wall of the fluidized bed combustor, and insulation surrounding said wall penetrating section.

6. A fluidized bed combustor according to claim 1, including a flange secured to said outer guide pipe adjacent to lower end thereof, a yoke secured to said coal supply pipe including a rod portion extending through the bottom of said flange and having an opening therethrough disposed above the top of said flange, and a locking pin engaged in the opening of said rod member and locking said rod member and said coal supply pipe against withdrawal from said outer guide pipe.

7. A fluidized bed combustor according to claim 6, wherein the portion of said outer guide pipe extending outwardly of said valve in said outer guide pipe defines a stuffing box surrounding said coal supply pipe, a sealing ring disposed around said coal supply pipe between said coal supply pipe and said outer guide pipe in said stuffing box located adjacent said valve in said outer guide pipe, packing extending exteriorly of said sealing ring being between said coal supply pipe and said outer guide pipe, the clamp flange carried by said outer guide pipe adjacent said bottom end of said outer guide pipe, a sleeve member insertable into the space between said outer guide pipe and said coal supply pipe adjacent the bottom end of said outer guide pipe, clamping bolt means defined between said sealing sleeve and said flange for tightening the packing in said stuffing box, a handle member extending outwardly from each side of said coal supply pipe, axially extending rod members connected to each of said handle members and extending axially through said clamp flange each having an opening therethrough posed above said clamp flange, and a U-shaped locking pin having leg portions engaged in respective openings of said rod members and locking said rod members and said coal supply pipe against withdrawal from said outer guide pipe.

8. A fluidized bed combustor, according to claim 7, including chain means holding said U-shaped locking pin to said clamp flange.

* * * * *